US005813734A

United States Patent [19]

Ong

[11] Patent Number: 5,813,734

[45] Date of Patent: Sep. 29, 1998

[54] FILING GUIDE

[76] Inventor: Bon S. Ong, P.O. Box 4247, Torrance, Calif. 90510

[21] Appl. No.: 715,002

[22] Filed: Sep. 17, 1996

[51] Int. Cl.[6] ..... B42F 13/02

[52] U.S. Cl. ..... 312/184; 40/359; 40/641; 312/348.4

[58] Field of Search ..... 312/183, 184, 312/193.4, 348.3, 348.5; 40/359, 641, 776, 537

[56] References Cited

U.S. PATENT DOCUMENTS

| | | | |
|---|---|---|---|
| 2,874,699 | 2/1959 | Dunleavy | 40/359 X |
| 3,885,726 | 5/1975 | Fridlund et al. | 40/359 X |
| 4,053,047 | 10/1977 | Snowden | 312/184 X |
| 4,193,218 | 3/1980 | Mermelstein | 312/184 X |
| 4,460,119 | 7/1984 | Goodfellow et al. | 40/331 X |
| 5,301,445 | 4/1994 | Hoffmeister | 40/537 |
| 5,405,020 | 4/1995 | Fotioo | 312/184 X |
| 5,439,280 | 8/1995 | Steinberg et al. | 312/184 |
| 5,503,487 | 4/1996 | Ong | 40/359 X |

*Primary Examiner*—Peter M. Cuomo
*Assistant Examiner*—Stephen Vu
*Attorney, Agent, or Firm*—Charles H. Thomas

[57] ABSTRACT

A file guide is formed for use in a hanging file that has a pair of rigid, laterally-spaced, parallel rails held elevated at the top of a file storage compartment, such as a file drawer. The file guide is formed of a thin, flat member that is longer than the distance between the parallel rails. The flat member has a pair of ears at its opposite ends in which rail openings are formed entirely within the structure of the ears. Each of the rail openings is large enough to receive and surround one of the rails. Access slits narrower than the rails are defined in the ears to extend between the rail openings and locations on the perimeter of the thin, flat member. The flat member is sufficiently elastically deformable to spread apart at the slits to permit passage of the rails therethrough. It is also sufficiently resilient to return to an undeformed condition to capture the rail within the rail openings after passage of the rail through the access slits. The thin, flat member may be formed as a narrow strip that extends only across the upper portion of the file compartment between the rails, or as a hanging structure that extends down into the file storage compartment. It may be formed as a multilayer structure in which pockets are defined, and also as a folded structure with a pair of retaining panels, each having a pair of ears of the type described. The retaining panels are joined at the bottom to form a sling, box-bottom file, tote file, or an expandable file.

4 Claims, 6 Drawing Sheets

FILING GUIDE

BACKGROUND OF THE INVENTION

1. Field of the Invention

The present invention relates to file guides and hanging files of the type utilized in office environments throughout the world.

2. Description of the Prior Art

Conventional hanging file systems typically are mounted in a filing cabinet or desk drawer. A hanging file normally includes a supporting metal framework that delineates a filing compartment generally in the shape of a rectangular prism. At its top the framework supports a pair of rigid, metal hanging file rails which are shaped as rod-like structures. These rails re oriented in mutually parallel relationship and are separated at a distance that is greater than the widths of the files to be maintained within the file storage compartment.

For many years hanging files have included file folders suspended from the rails by means of laterally projecting hooks that rest atop and extend beyond the rails. These hooks are generally formed as the extremities of linear, metal members that pass through sleeves formed at the tops of retaining panels that are each formed of a single sheet of flat stock, folded in half to form open-ended hanging folders or slings. The hooks at the opposite ends of each of the retaining panels suspend the retaining panels from the rails. The hooks can slide easily along the rails to permit access to any selected hanging file. Documents of different types are placed in the open-ended sling formed by each hanging file. By sliding one retaining panel of a hanging file away from the other, a user can look into and more easily gain access to the contents of the hanging file.

One difficulty with the conventional construction of hanging files is that as a user reaches into the hanging file to withdraw the contents therefrom, the documents in the hanging file will frequently catch on the undersides of the members terminating in the hooks, and pull the hanging file off of the framework. As a consequence, the remaining contents of the hanging file are very frequently dumped to the bottom of the file drawer. This represents an unnecessary and annoying disruption to the user, as the documents spilled out of the hanging file must be retrieved from the bottom of the file drawer, the hanging file retaining panels must be replaced properly so that their hooks again rest atop the rails, and the disturbed contents of the hanging file must be resorted.

Also, when a user reaches into a conventional hanging file to remove documents therefrom, the user will sometimes inadvertently grip one or another of the retaining panels of the hanging file, and lift the retaining panel out along with the documents. This likewise often results in a dumping of documents from the hanging file into the bottom of the filing cabinet drawer.

To guard against spillage of the contents of a hanging file, a user will sometimes purposefully seize the entire hanging file folder to lift the entire sling structure including both of the retaining panels and the contents of the hanging file out of the hanging file rack. This allows the user to more easily inspect the contents of the hanging file, and also provides a measure of protection against spilling the contents of the file down into the bottom of the file drawer. However, unless the user marks the place from which the hanging file has been removed, valuable time can be lost in searching for the proper location in the hanging file rack at which to replace the file.

To mark the location from which a hanging file has been removed, a file guide often is employed. A conventional filing guide may take the form of simply a stiff sheet of cardstock or a sheet of plastic that is inserted into the hanging file between the rails to mark the location from which a hanging file folder has been removed. However, particularly in file drawers from which some of the contents have been removed, a conventional file guide will tend to slide down from its proper, upright position, to an orientation at least partially extending beneath other hanging file folders. When a file guide slips down in a file drawer in this manner, it is no longer readily visible, and thus fails to perform its intended function of marking the location from which a hanging file folder has been withdrawn. Also, a conventional file guide may drop down completely, flat onto the floor of the filing drawer. When this occurs a significant number of files must be removed from the file drawer merely to retrieve the filing guide.

To remedy this problem filing guides have sometimes been provided with laterally projecting hooks that rest atop the rails of the hanging file in a manner similar to the hooks of hanging file folders. However, since these hooks merely rest atop the rails of the hanging file, they are often dislodged from one or both of the rails, so that conventional filing guides still drop down into the file.

SUMMARY OF THE INVENTION

A primary object of the present invention is to provide a means for releasably securing filing guides and hanging files to the rails of a hanging file system in a manner that allows the hanging files and the file guides to be easily moved back and forth in the file atop the rails, as in conventional systems, but in such a manner that they do not readily become dislodged from the rails. To this end the hooks that have historically formed a part of the files are replaced with ears at the ends of a filing guide or at the ends of the retaining panels of a hanging file folder. These ears are provided with openings defined entirely within their structures that are large enough to readily accommodate the rails therewithin. The rails project through the rail openings in the ears, which are large enough to afford considerable clearance to the rails. The hanging folders and filing guides can then easily be pushed back and forth along the rails, but will not readily become disengaged therefrom as do the hooks of conventional file folders and filing guides.

In order to permit the filing guides and the hanging files to be readily removed from the hanging file, some means must be provided to allow the ears to be disengaged from the rails without undue difficulty. This objective is achieved by providing each of the ears with an access slit that extends between the rail opening in the ear and the bounding perimeter of the structure of the filing guide or hanging folder retaining panel on which the ear is formed. The filing guide or hanging folder retaining panel is formed of a thin, flat sheet material that is sufficiently elastically deformable to spread apart at the slits to permit passage of the rails through the slits. The material forming the filing guides and hanging folders of the invention is also sufficiently resilient to return to an undeformed condition to capture the rails within the rail openings after passage of the rails through the access slits.

As a consequence, although the ears firmly maintain the hanging files and file guides of the invention on the rails in sliding engagement therewith unless some force is exerted to purposely disengage them from the rails, the ears can be readily disengaged from the rails upon the application of such a force. In the preferred embodiments of the invention the ears of the retaining panels and filing guides may be readily disengaged from the rails merely by twisting the free extremities of the ears out of the plane of the filing guide or retaining panel, thereby increasing the width of the slits substantially. The filing guide or file folder can then be readily lifted up from the rails.

The device of the invention can be just as readily reengaged with the rails. That is, to replace the filing guide or hanging file, the ears are merely forced downwardly against the rails. The resilient structure of the filing guide or hanging file again causes the free extremities of the ears to twist out of the plane of the remaining structure thereof, to permit passage of the rails through the access slits in the ears. As soon as the rails clear the slits, the resilient nature of the thin, flat member forming the filing guide or hanging file folder of the invention returns the ear to its undeformed condition in which the slit is much too narrow to permit the ears from being inadvertently pulled off of the rails of the hanging file framework.

In one broad aspect the present invention may be considered to be a filing guide for use in a hanging file that has a pair of rigid, laterally-spaced, parallel rails held elevated at the top of a file storage compartment. The file guide is comprised of a thin, flat member longer than the distance between the parallel rails. This thin, flat member has a bounding perimeter and defines at its opposite ends within that perimeter a pair of rail openings that are formed entirely within the structure of the flat member. Each of the rail openings is large enough to receive and surround one of the rails. The thin, flat member further defines access slits narrower than the rails in its opposite ends. These access slits extend between the rail openings and the bounding perimeter. The flat member is sufficiently deformable to spread apart at the slits to permit passage of the rails through the slits. It is also sufficiently resilient to return to an undeformed condition to capture the rails within the rail openings after passage of the rails through the access slits.

In another broad aspect the invention may be considered to be a hanging file for use with a pair of rigid, laterally-spaced, parallel rails held elevated at the top of a file storage compartment. The hanging file is comprised of a thin, flat member having a boundary perimeter and bent to form at least one bottom fold at its center and a pair of expansive retaining panels extending upwardly from the bottom fold. Each of the retaining panels has a lower portion that extends below and hangs beneath the rails and an upper portion longer than the lower portion and including a pair of laterally-projecting ears. The projecting ears extend beyond the rails.

Each of the ears defines therewithin a rail opening formed entirely within the structure of the flat member. Each of the rail openings is large enough to receive and surround one of the rails. The ears further define access slits therein that are narrower than the rails. The access slits extend between the boundary perimeter and the rail openings. The flat member is sufficiently elastically deformable to spread apart at the slits to permit passage of the rails through the slits. It is also sufficiently resilient to return to an undeformed condition to capture the rails within the openings after passage of the rails through the access slits. The retaining panels are thereby suspended from the rails by the laterally projecting ears.

In still another broad aspect the invention may be considered to be, in combination, a pair of rigid, laterally-spaced, parallel hanging file rails and a thin, flat member. The thin, flat member is transversely oriented relative to the hanging file rails. The thin, flat member has a boundary perimeter and a pair of laterally-projecting ears that extend beyond the hanging file rails. Each of the ears defines within its structure a rail opening large enough to receive and surround one of the rails. Each ear also defines within its structure a slit narrower than the rails and leading from the opening to the boundary perimeter. The flat member is resilient enough to elastically deform to permit passage of the rails through the slits when the ears are forced onto the rails. It is also resilient enough to return to an undeformed shape to capture the rails within the rail openings after the rails have cleared the slits.

The invention may be described with greater clarity and particularity with reference to the accompanying drawings.

DESCRIPTION OF THE EMBODIMENTS

Figure 1:
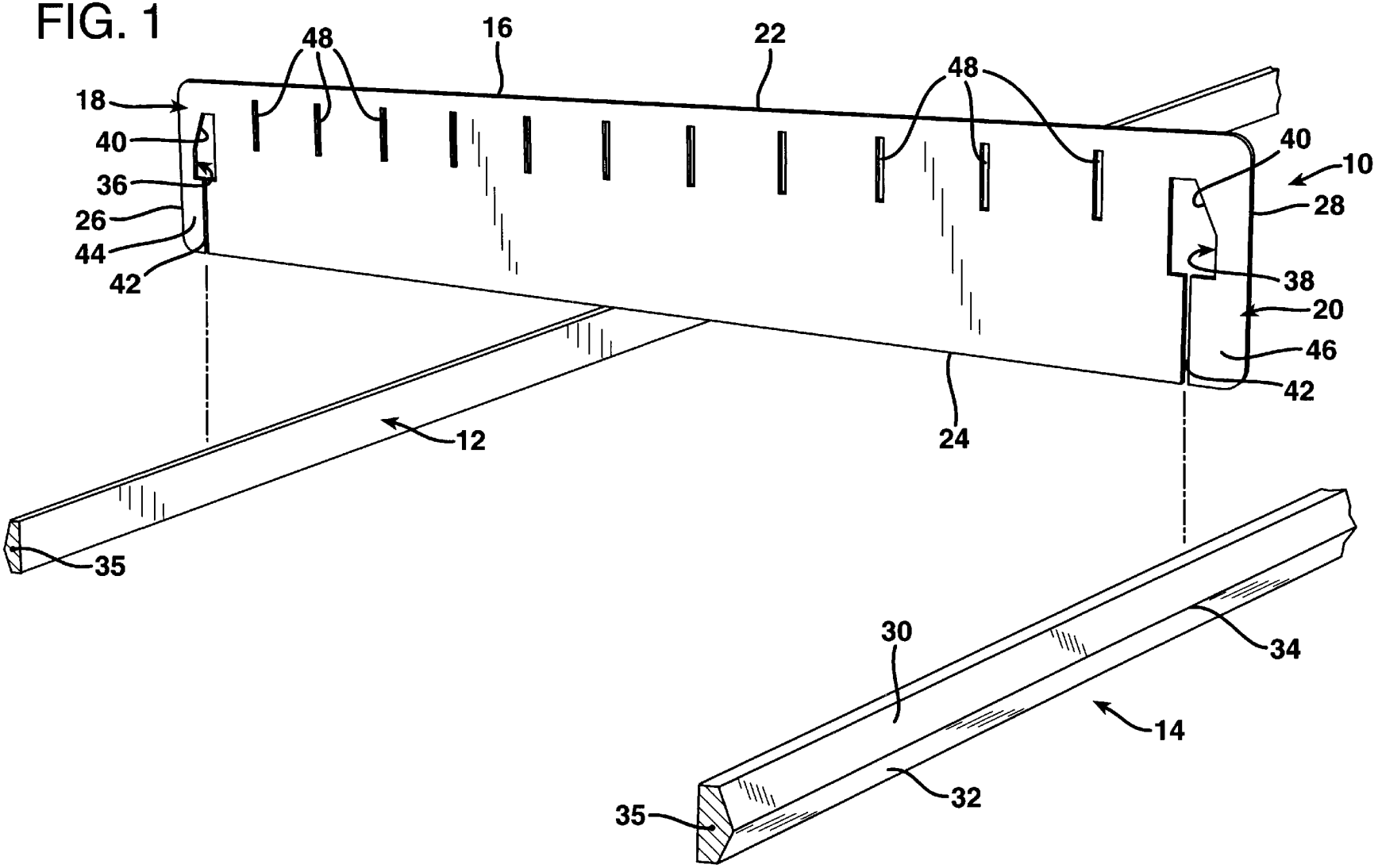
FIG. 1 is a perspective view illustrating a combination constructed according to the invention in which the thin, flat member employed is a file guide.

FIG. 1 illustrates a file guide indicated generally at 10 employed in combination with a pair of rigid, laterally-spaced, parallel hanging file rails 12 and 14. The file rails 12 and 14 are held elevated at the top of a file storage compartment, such as a file drawer, by a supporting framework in a conventional manner.

The file guide 10 is formed of a long, narrow strip from polypropylene or stiff cardboard stock, typically between about ten and thirty mils in thickness. The file guide 10 has a boundary perimeter 16. The boundary perimeter 16 is generally rectangular in shape but has rounded corners for safety reasons.

The opposite ends 18 and 20 of the file guide 10 are configured as a pair of laterally-projecting ears. The file guide 10 is longer than the distance between the parallel rails 12 and 14 and has a top edge 22 and a bottom edge 24. Vertical side edges 26 and 28 extend between the top and bottom edges 22 and 24 at the extremities of the ears 18 and 20.

The rails 12 and 14 are both of a uniform cross section throughout their lengths and both have the cross-sectional configuration of a pentagon with mutually parallel top and bottom sides and with an inside surface perpendicular to the top and bottom sides. The outsides of the rails 12 and 14 are formed of planar, intersecting upper and lower surfaces 30 and 32, respectfully, which intersect each other in a linear apex 34 located at the same height as the centers 35 of the rails 12 and 14. Since the surfaces 30 are inclined upwardly and inwardly above the level of the rail centers 35, the shape of the upper portions of the rails narrows in cross section above the rail centers 35.

Figure 2:
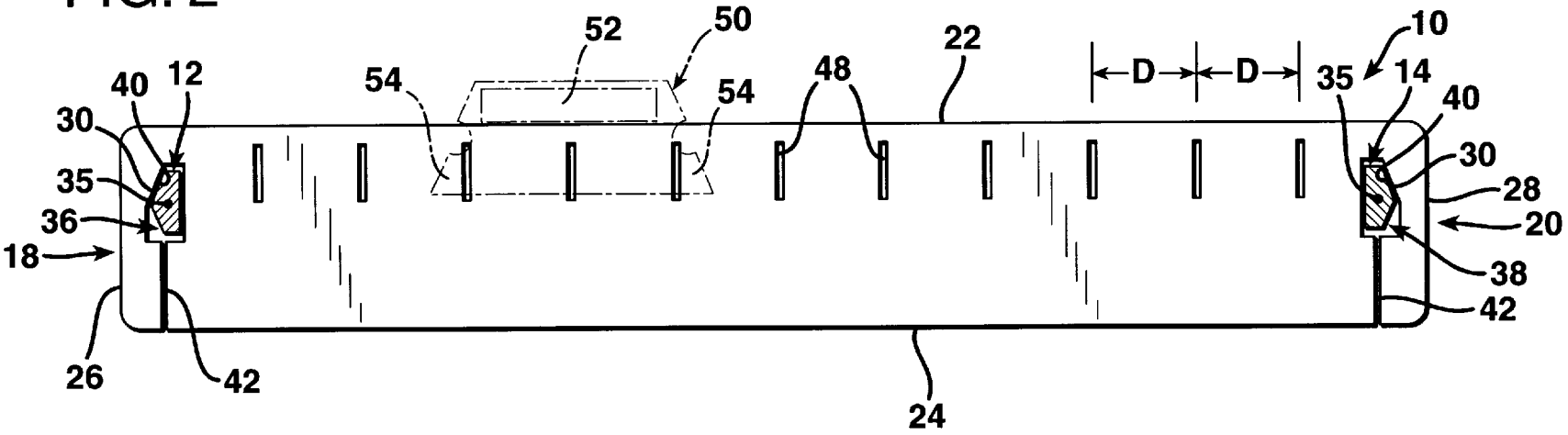
FIG. 2 is a front view showing the combination of FIG. 1.

A pair of rail openings 36 and 38 are formed entirely within the structure of the flat member forming the file guide 10. The rail openings 36 and 38 each also have a pentagonal shape with mutually parallel upper and lower sides. The inside edge and the lower portion of the outside edge of each of the openings 36 and 38 are also mutually parallel. The remaining edges 40 bounding the enclosures of the rail openings 36 and 38 are inclined upwardly and inwardly at more or less the same angle of inclination as the surfaces 30 on the rails 12 and 14. The shape of the upper portions of the rail openings 36 and 38 thereby conforms to the shape of the cross section of the rails 12 and 14 above their centers 35, as best depicted in FIG. 2. As a consequence, the weight of the file guide 10 tends to create a certain wedging effect so as to hold the file guide 10 upright and in a perpendicular orientation relative to the rails 12 and 14.

Figure 3:
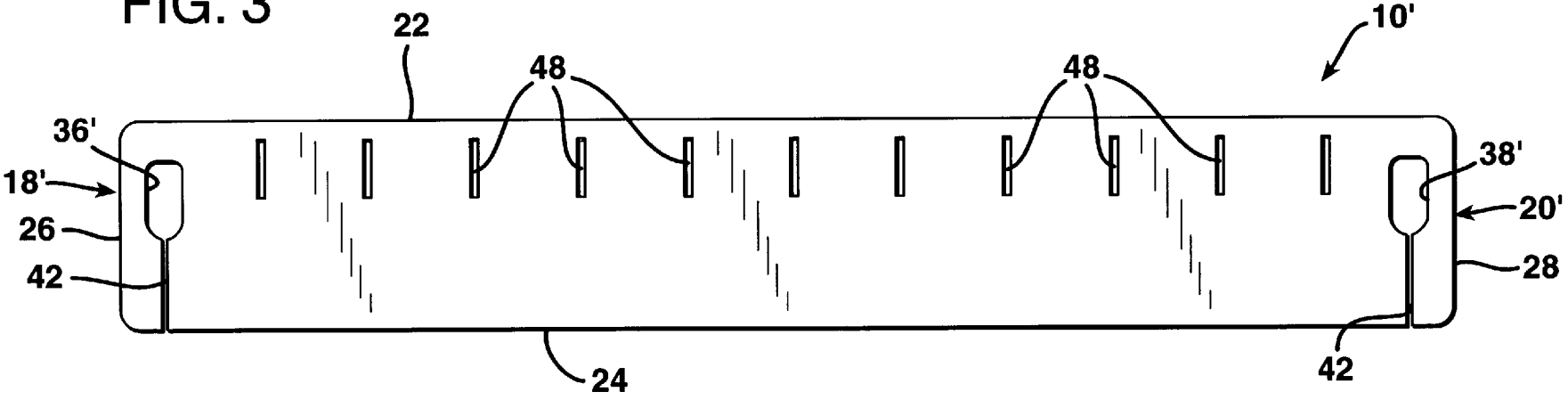
FIG. 3 illustrates an alternative embodiment of a file guide to that depicted in FIGS. 1 and 2.

It is to be understood, however, that the rail openings may have virtually any shape, as long a they are large enough to surround the rails 12 and 14 loosely enough to permit free longitudinal movement of the file guide 10 along the rails 12 and 14. For example, FIG. 3 illustrates a file guide 10' in which rail openings 36' and 38' are formed in the file guide ears 18' and 20', respectively. The ears 18' and 20' extend beyond the rails 12 and 14. Each of the ears 18' and 20' defines therewithin an oblong rail opening 36' and 38', respectively, formed entirely within the structure of the flat member 10'. Each of the rail openings 36' and 38' is large enough to receive and surround one of the rails 12 or 14. The ears 18' and 20' define narrow access slits 42 therein. The access slits 42 are narrower than the rails 12 and 14 and extend between the boundary perimeter of the thin, flat member 10' and the rail openings 36' and 38'. The rail openings 36' and 38' are both of an oblong configuration and narrow in their lower regions to intersect the access slits 42.

The rail openings 36 and 38 of the file guide 10 are entirely surrounded in a lateral direction by the structure of the ears 18 and 20, respectively, and are defined entirely within the flat, planar structure of the file guide 10. To allow the file guide 10 to be readily attached to and detached from the rails 12 and 14, access slits 42, considerable narrower than the rails 12 and 14, are defined in the ears 18 and 20 at the opposite ends of the file guide 10. The access slits 42 extend between the rail openings 36 and 38 and the bottom edge 24 of the boundary perimeter 16 of the file guide 10.

To install the file guide 10 on the rails 12 and 14, a user simply orients the file guide 10 transversely above the rails 12 and 14, as illustrated in FIG. 1, and moves the file guide 10 vertically downwardly. The file guide ends are pressed against the rails 12 and 14 while twisting the free extremities 44 and 46 of the ears 18 and 20 out of the plane of the remaining structure of the flat file guide 10. This greatly increases the gaps defined between the mutually parallel, opposing edges of the slits 42, thereby permitting passage of the rails 12 and 14 through the slits 42 until they enter the rail openings 36 and 38.

Once the rails 12 and 14 clear the slits 42, the free extremities 44 and 46 of the ears 18 and 20 are released. The structure of the flat guide member 10 is sufficiently resilient so that the free extremities 44 and 46 return to an undeformed condition and spring back into coplanar relationship with the remaining, planar structure of the file guide 10. As illustrated in FIG. 2, the rails 12 and 14 are thereby captured within the rail openings 36 and 38 after passage of the rails 12 and 14 through the access slits 42. FIG. 2 illustrates the engagement of the file guide 10 on the rails 12 and 14 once the rails 12 and 14 have cleared the slits 42.

To maximize the effectiveness of its use, the file guide 10 is preferably provided with a plurality of vertical index tab slots 48 that are spaced a uniform, predetermined, tab-insertion, incremental distance apart along the length of the file guide 10. This distance is indicated at D in FIG. 2.

The file guide 10 is preferably additionally provided with a stiff index tab 50, depicted in phantom in FIG. 2. The index tab 50 is of a conventional construction and includes a label 52 and a pair of mounting projections 54 that extend in opposite lateral directions and are spaced apart from each other a spacing distance equal to an integer multiple of the tab insertion incremental distance D. In the embodiment illustrated in FIG. 2 the tab insertion incremental distance between the two mounting projections 54 is equal to twice the distance D, although it is to be understood that is could also be equal to the distance D, three times the distance D, or any other integer multiple of the spacing between the index tab slots 48.

With the construction of the file guide 10 and index tab 50 as described and depicted, the index tab 50 is alternatively positionable at different selected locations along the length of the flat file guide 10 by selective and alternative engagement of the tab mounting projections 54 in different ones of the tab slots 48. That is, the index tab 50 can be selectively positioned either to the extreme right, to the extreme left, or at any intermediate position therebetween along the length of the file guide 10 by selective insertion of the mounting projections 54 in the appropriate index tab slots 48.

Figure 4:
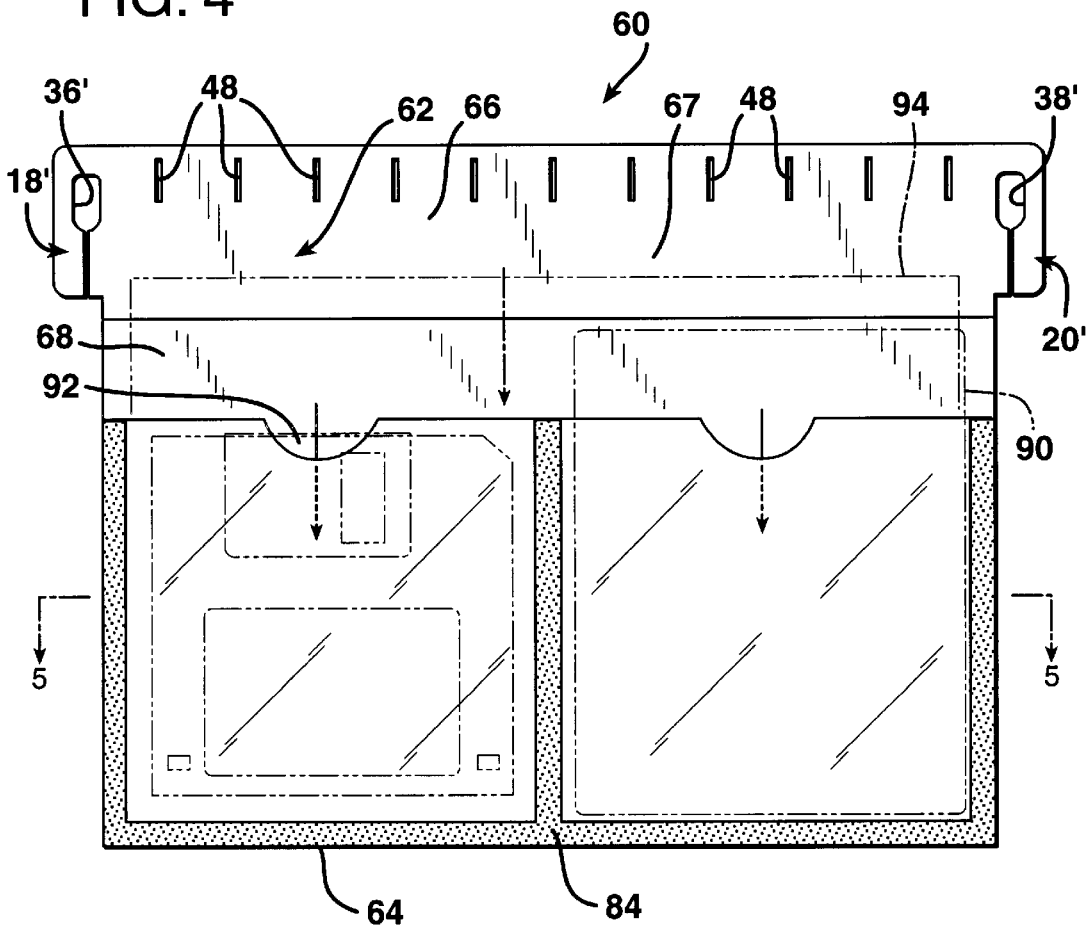
FIG. 4 is a front elevational view of one embodiment of a hanging file constructed accordingly to the invention.
Figure 5:
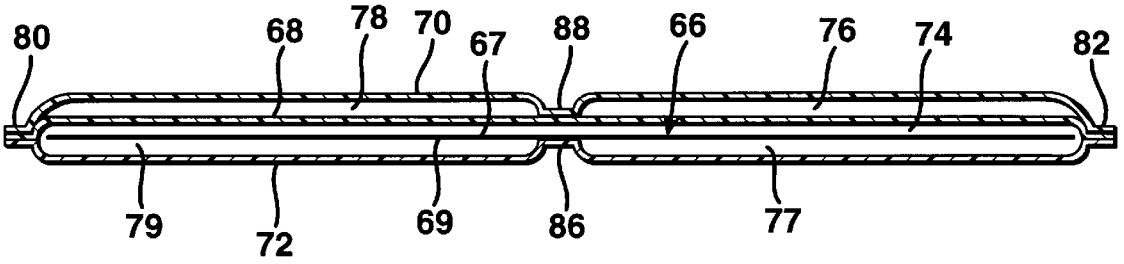
FIG. 5 is a sectional elevation view taken along the lines 5—5 of FIG. 4.

FIGS. 4 and 5 of the drawings illustrate a file guide 60 that also serves as a hanging file. The file guide 60 is formed of a polypropylene, die cut, flat base sheet 62 that has an expansive lower portion 64 that extends below and hangs beneath the rails 12 and 14 and a narrow upper portion 66 that is longer than the lower portion 64. The upper portion 66 of the base sheet 62 is formed with a pair of laterally projecting ears 18' and 20' with rail openings 36' and 38' and access slits 42 defined therein as previously described. The base sheet 62 has a front surface 67 and a back surface 69.

The file guide 60 is also comprised of an apron overlay 68 and a plurality of layers 70 and 72 of one or more facing sheets. The apron 68 and the front facing sheet 70 both overlie the front surface 67 of the lower portion 64 of the base sheet 62 and are secured to the base sheet 62 to form a plurality of pockets 74, 76, and 78 between the stiff base sheet 62, the apron sheet 68, and the overlying facing sheet 70. In a similar manner the back facing sheet 72 overlies the back surface 69 of the base sheet 66 and is secured thereto to form pockets 77 and 79 therebetween.

Prior to their connection to the base sheet 62 the apron 68 and the front facing sheet 70 are heat sealed together at their centers in the vertical region indicated at 88 throughout their mutual interface of contact. The back facing sheet 72 is heat sealed down its center in the region indicated at 86 in FIG. 5 to the lower portion 64 of the base sheet 62 in contact with the back surface 69 thereof.

The front face sheet 70, the apron sheet 68, and the back facing sheet 72 are all heat sealed together along their peripheral side edge margins 80 and 82 and along their peripheral bottom edge margins 84 to form the pockets 74, 76, 77, 78, and 79. The overlying sheets 68, 70, and 72 are thereby all secured to the base sheet 62 through the heat sealed interface between the back facing sheet 72 and the back surface 69 of the lower portion 64 of the base sheet 62.

The two front pockets 76 and 78 are preferably both of a size to receive items commonly utilized in offices. For example, both of the pockets 76 and 78 may be of a size suitable for receiving either a standard five and a quarter inch compact disc, indicated in phantom at 90, or a standard three and a half inch computer disk indicated at 92 in FIG. 4.

The pockets 77 and 79 between the rear facing sheet 72 and the lower portion 64 of the base sheet 62 are substantially the same size as the pockets 76 and 78. The pocket 74 that is defined between the overlying apron 78 and the front surface 67 of the base sheet 62 is of a larger size suitable for receiving standard, eight and a half by eleven inch documents, as indicated in phantom at 94 in FIG. 4.

Figure 6:
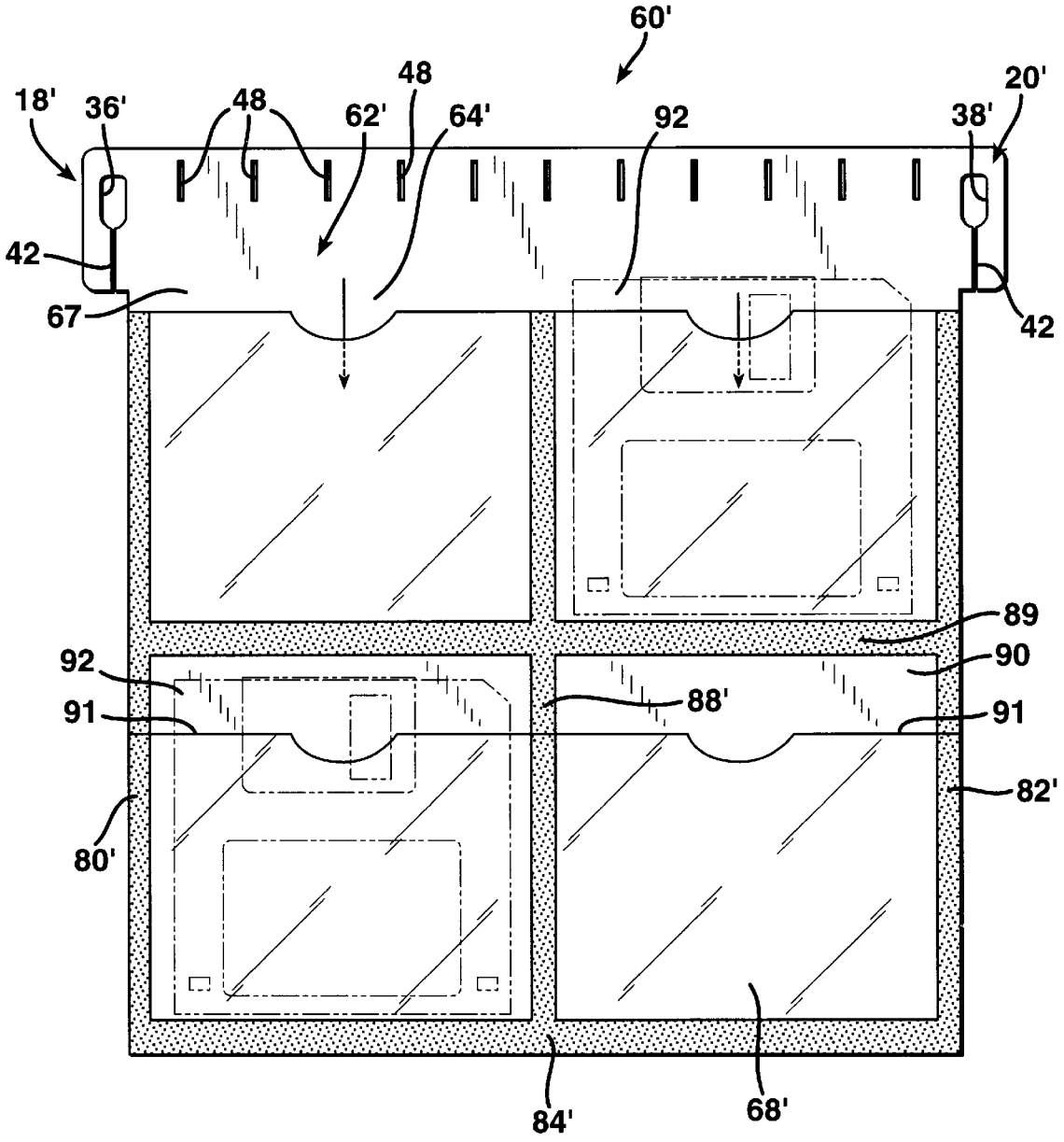
FIG. 6 illustrates an alternative form of hanging file constructed according to the invention.

FIG. 6 illustrates a combination hanging file and file guide 60' which represents a variation of the device 60 illustrated in FIGS. 4 and 5. The file guide 60' is configured so as to define four pockets of uniform dimensions at both the front face 67 of the base sheet 62' and at the rear face thereof, which is not visible in FIG. 6. The front and back overlying sheets 68' are identical to each other and are each configured to define four pockets, all of which will receive either compact discs 90 or computer disks 92.

The overlying sheets 68' are heat sealed to the lower portion of the base sheet 62' along the vertical peripheral side margins 80' and 82' and along the lower, peripheral, bottom edge margin 84'. The overlying sheets 68' are heat sealed to each other and to the base sheet 62' throughout a central, vertically-extending region 88' and throughout a horizontally-extending region 89 about one-half way down the lower portion 64' of the base sheet 62'. The sheets 68' are each cut horizontally beneath the region 89 to define lower pocket access edges 91 with finger grip recesses therein. Each sheet 68' thereby defines four pockets of uniform size on both the front surface 67 of the base sheet 62' and also on the back surface of the base sheet 62'.

The lower portion 64' of the base sheet 62', like the lower portion 64 of the base sheet 62, is of a rectangular configuration. However, the lower portion 64' of the base sheet 62' is considerably longer than the lower portion 64 of the base sheet 62. The ears 18' and 20' of the file guide 60' are of the construction previously described.

Figure 7:
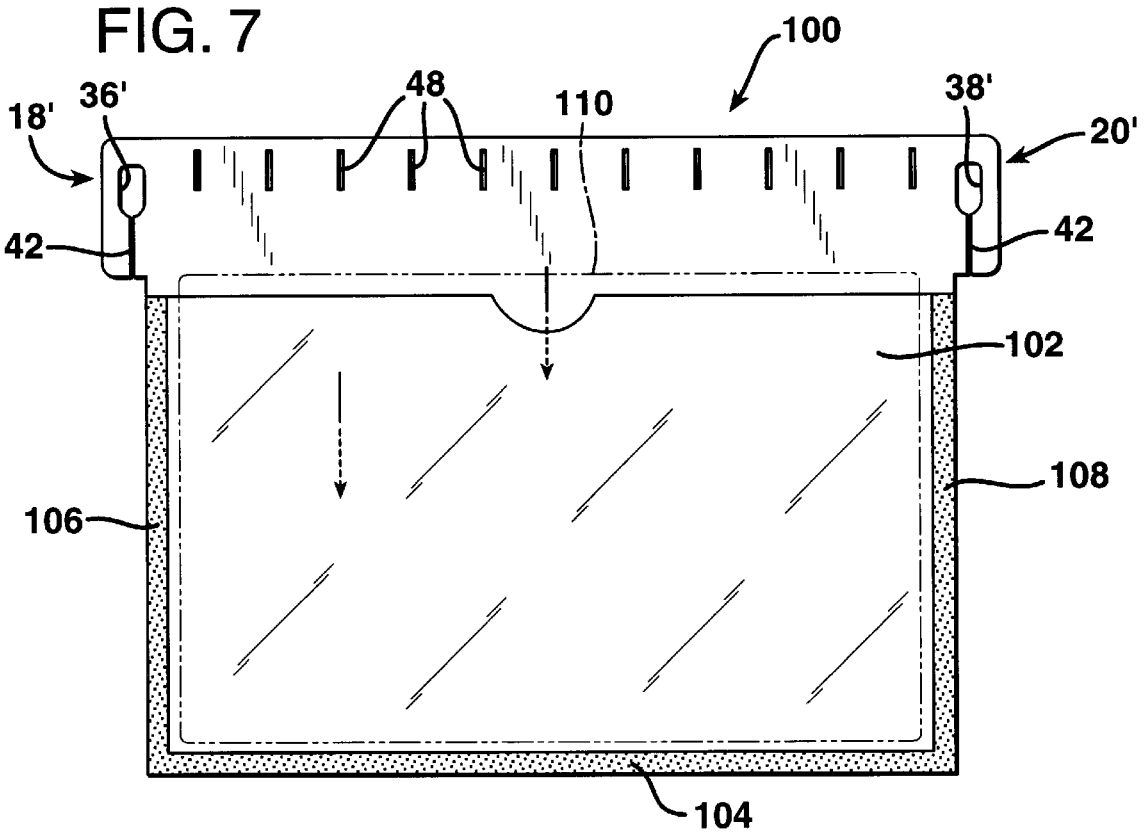
FIG. 7 illustrates another alternative form of file guide constructed according to the invention

FIG. 7 illustrates another combination hanging file and file guide 100. The thin, flat hanging file and file guide member 100 includes a base sheet 62 formed with a narrow, upper section 66 at the opposite ends of which the ears 18' and 20', previously described, are formed. The base sheet 62 also includes an expansive lower section 64 that hangs by the ears 18' and 20' beneath the rails 12 and 14. The file guide 100 employs the same base sheet 62 utilized in the combination file guide and hanging file 60 depicted in FIGS. 4 and 5. At least one face sheet overlies at least a portion of the lower section 64 of the base sheet 62 and is secured thereto along a portion of the boundary perimeter to define at least one pocket with the base sheet 62. In the thin, flat member 100, a single overlying sheet 102 is employed to form a single pocket between the base sheet 62 and the overlying face sheet 102.

The device 100 differs from the combination file guide and hanging file 60 in that the embodiment 100 includes only a single, full-width pocket formed by a single, transparent, plastic sheet 102 disposed across the front face 67 of the lower portion 64 of the base sheet 62. The plastic sheet 102 is heat sealed across the lower edge margin 104 of the lower portion 64 of the base sheet 62, and also along the vertical side edge margin 106 and 108. The face sheet 102 is open at its top to form a pocket suitable for receiving a document, such as an index sheet 110 therein.

Figure 8:
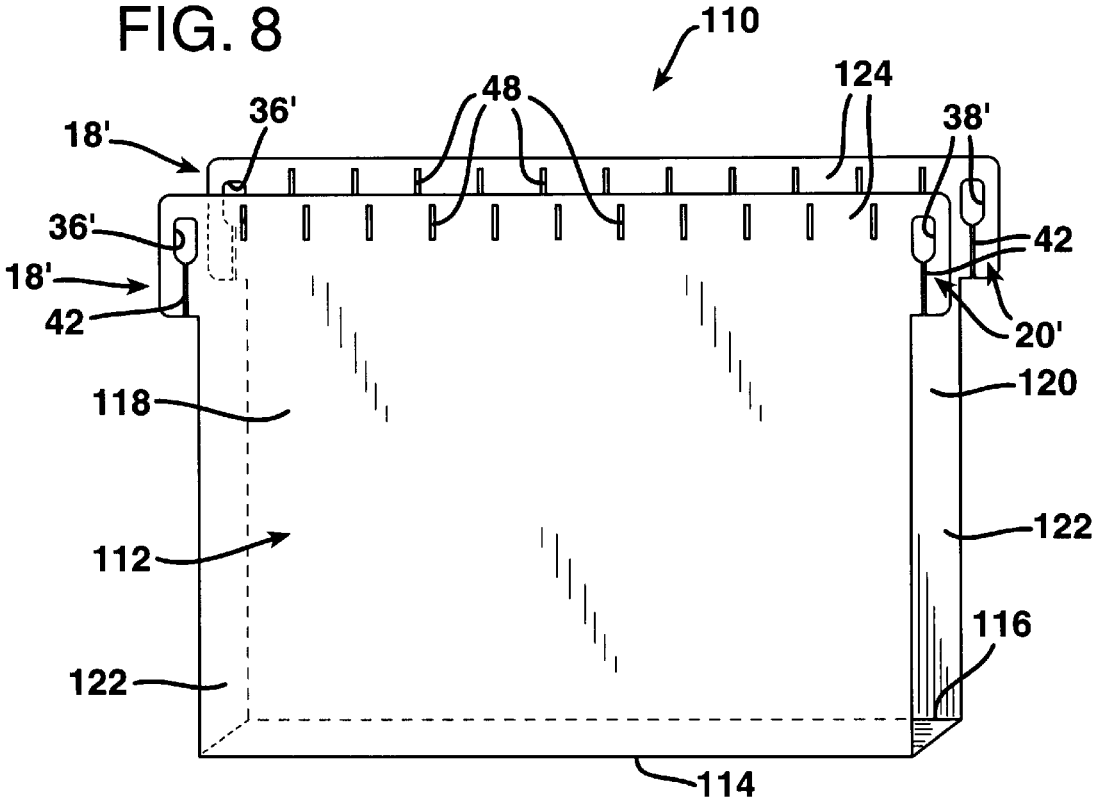
FIG. 8 is an isometric view illustrating another alternative hanging file constructed according to the invention.

FIG. 8 illustrates an alternative embodiment of the invention depicting a hanging box bottom file 110, also designed for use with the pair of rigid, laterally-spaced, parallel rails 12 and 14. The hanging file 110 is comprised of a thin, flat structure die cut from a single sheet of stock and bent to form at least one, and in the embodiment depicted a pair, of bottom folds 114 and 116, as well as a pair of expansive retaining panels 118 and 120. Each of the panels 118 and 120 is die cut with a pair of ears 18' and 20' and a plurality of index tab slots 48 of the type previously described.

The expansive retaining panels 118 and 120 extend upwardly from the bottom folds 114 and 116, respectively. Each of the retaining panels 118 and 120 has a lower portion 122 that extends below and hangs beneath the rails 12 and an upper portion 124. Each of the retaining panel upper portions 124 includes a pair of laterally projecting ears 18' and 20' of the type previously described.

The flat member 112 is sufficiently elastically deformable to spread apart at the slits 42 to permit passage of the rails 12 and 14 through the slits 42 in the manner depicted and described in connection with FIGS. 1–3. The structure of the thin, flat member 112 is sufficiently resilient to return to an undeformed condition to capture the rails 12 and 14 within the rail openings 36' and 38' after passage of the rails 12 and 14 through the access slits 42. In this way the retaining panels 118 and 120 are both suspended from the rails 12 and 14 by the laterally projecting ears 18' and 20' to form a box bottom sling therebetween. Loose papers, file folders, booklets, and other documents may be placed in the sling formed between the retaining panels 118 and 120.

Figure 9:
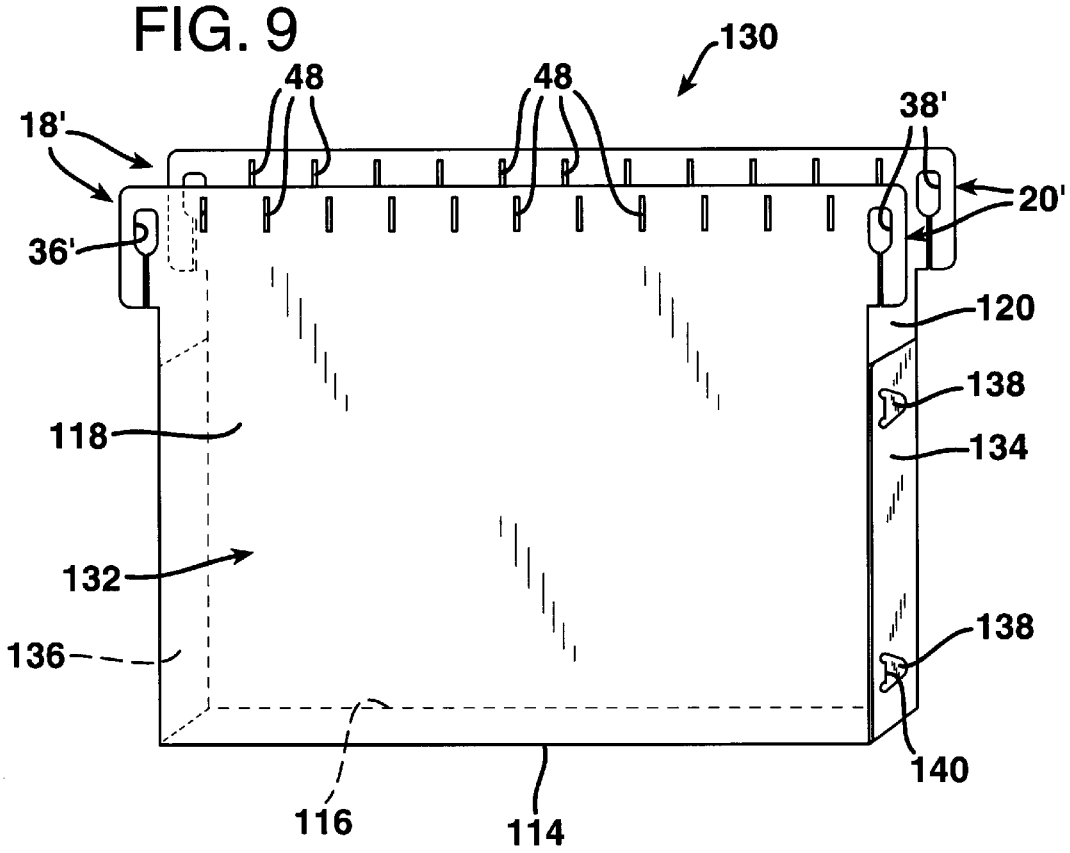
FIG. 9 is an isometric view illustrating still another alternative hanging file constructed according to the invention.

FIG. 9 illustrates another hanging file 130 constructed according to the invention which is a variation of the hanging file 110 depicted in FIG. 8. The hanging file 130 is also formed of a single, flat member 132 die cut from a single sheet of card stock or stiff paper to form front and back retaining panels 118 and 120 of the type previously described. The flat member 132 is also bent to form a pair of bottom folds 114 and 116, and also has a pair of side panels projecting from both of the transverse retaining panels 118 and 120. The side panels 134 and 136 connect the retaining panels 118 and 120 together beneath the ears 18' and 20'.

To effectuate this connection the side panels 134 and 136 are die cut to form interlocking connectors. Specifically, the panels 136 are die cut to form barbed, arrowhead-shaped projecting tongues 138, while the side panels 134 are die cut with linear slots 140 that are vertically aligned with the tongues 138 when the flat member 132 is bent to define the bottom folds 114 and 116. The side panels 134 and 136 of each retaining panel are folded along their side edges toward the opposing retaining panel with the side panels 134 being folded over the outsides of side panels 136. The tongues 138 defined on the side panels 136 are then manually pressed out of the planes of the side panels 136 and inserted through the vertically aligned slots 140. The structure of the tongues 138 is sufficiently resilient to allow the tongues 138 to pass through the slots 140. However, the barbs at the bases of the tongues 138 prevent them from accidentally dislodging from the vertically aligned slots 140. The hanging file 130, when assembled as depicted in FIG. 9, is of a type known as a tote file.

Figure 10:
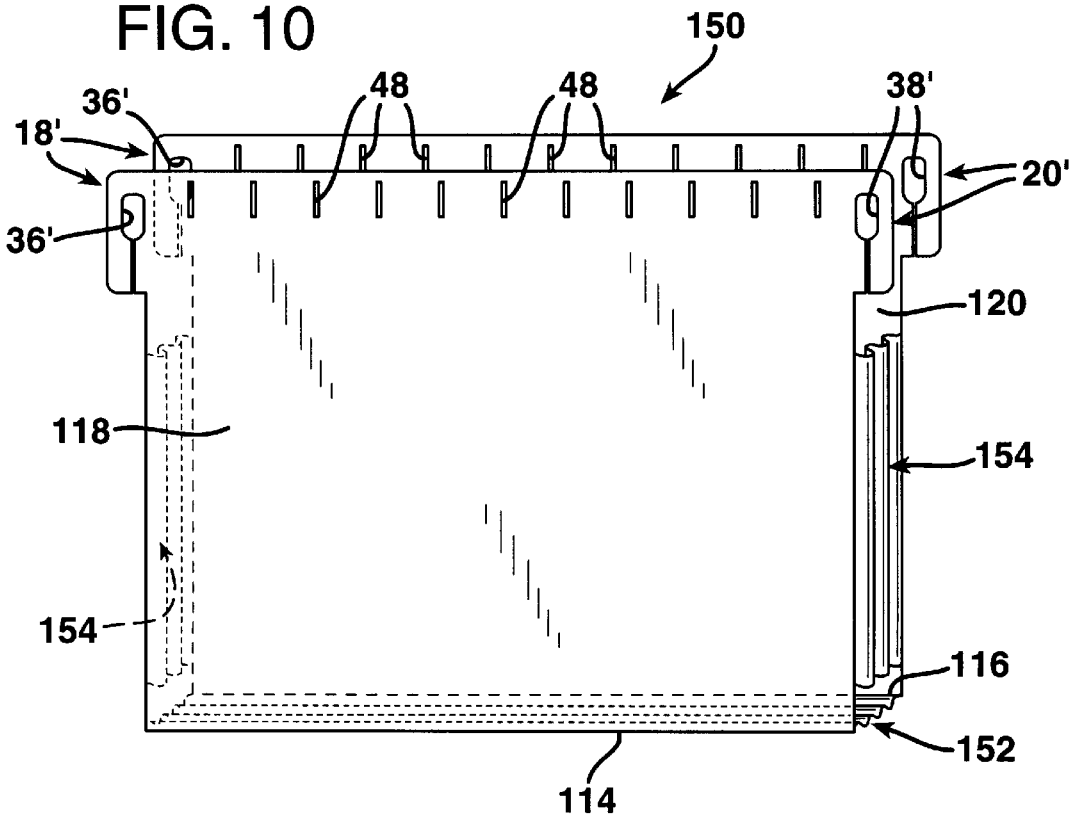
FIG. 10 is an isometric view illustrating another alternative hanging file according to the invention.

FIG. 10 illustrates another hanging file 150, constructed according to the invention. The hanging file 150 is of the type known as an expanding file. The expanding file 150 resembles the tote file 130 in some respects, but differs in others. Specifically, the expanding file 150 includes not only the bottom folds 114 and 116 that form the lower edges of the retaining panels 118 and 120, respectively, but also several bottom folds indicated collectively at 152. The bottom folds 152 between the bottom edge folds 114 and 116 are bent back upon each other to form a pleated bottom to the hanging file 150 with accordion folds therein between the retaining panels 118 and 120.

The expanding file 150 is further comprised of side panels 154 beneath the ears 118 and 120. The side panels 154 are die cut from the same flat sheet of stock as the retaining panels 118 and 120 and extend laterally from the retaining panel 120. The side panels 154 each include a plurality of reversing bends therein, as depicted in FIG. 10, to form accordion folds between the sides of the retaining panels 118 and 120. The initially free ends of the pleated side panels 154 are glued or otherwise secured to the surface of the retaining panel 118 that faces the retaining panel 120, along the side margins thereof.

Undoubtedly, numerous variations and modifications of the invention will become readily apparent to those familiar with office supply products. Accordingly, the scope of the invention should not be construed as limited to the specific embodiments depicted and described herein.

I claim:

1. A file guide for use in a hanging file that has a pair of rigid, laterally-spaced, parallel rails held elevated at the top of a file storage compartment wherein said rails are of a uniform cross section throughout their lengths and said rails narrow in cross-sectional thickness both above and below their centers, comprising: a thin, flat member longer than the distance between said parallel rails and having a bounding perimeter and defining at its opposite ends within said perimeter a pair of rail openings formed entirely within the structure of said flat member, and said rail openings have upper and lower portions and the shape of said upper portions of said rail openings conforms to the shape of the cross-sectional thickness of said rails above said centers of said rails, wherein each of said rail openings is large enough to receive and surround one of said rails, said flat member further defining access slits narrower than said rails in said opposite ends of said flat member that extend between said rail openings and said perimeter, and said flat member is sufficiently elastically deformable to spread apart at said slits thereby being adapted to permit passage of said rails through said slits and sufficiently resilient to return to an undeformed condition thereby being adapted to capture said rails within said rail openings after passage of said rails through said access slits.

2. A file guide for use in a hanging file that has a pair of rigid, laterally-spaced, parallel rails held elevated at the top of a file storage compartment comprising: a thin, flat member longer than the distance between said parallel rails and having a bounding perimeter and defining at its opposite ends within said perimeter a pair of rail openings formed entirely within the structure of said flat member, wherein each of said rail openings is of an oblong configuration and is large enough to receive and surround one of said rails, said flat member further defining access slits narrower than said rails in its opposite ends that extend between said rail openings and said perimeter, and wherein said rail openings narrow to intersect said access slits, and said flat member is sufficiently elastically deformable to spread apart at said slits, thereby being adapted to permit passage of said rails through said slits and sufficiently resilient to return to an undeformed condition, thereby being adapted to capture said rails within said rail openings after passage of said rails through said access slits.

3. A file guide according to claim 2 wherein said thin, flat member is comprised of a stiff sheet that has a lower portion that extends below and hangs beneath said rails, and an apron overlying said lower portion of said sheet and secured thereto to thereby form at least one pocket between said stiff sheet and said apron.

4. A file guide for use in a hanging file that has a pair of rigid, laterally-spaced, parallel rails held elevated at the top of a file storage compartment comprising: a thin, flat member longer than the distance between said parallel rails and having a bounding perimeter and comprised of a stiff sheet that has a lower portion that extends below and hangs beneath said rails and an upper portion that is wider than said lower portion and defines at its opposite ends within said perimeter a pair of laterally projecting ears and a pair of rail openings formed entirely within the structure of said laterally projecting ears of said flat member, wherein each of said rail openings is large enough to receive and surround one of said rails, said flat member further defining access slits narrower than said rails in said laterally projecting ears at said opposite ends of said flat member that extend between said rail openings and said perimeter, and said flat member is sufficiently elastically deformable to spread apart at said slits, thereby being adapted to permit passage of said rails through said slits and sufficiently resilient to return to an undeformed condition, thereby being adapted to capture said rails within said rail openings after passage of said rails through said access slits, and wherein said stiff sheet is a base sheet and has opposing front and back surfaces and further comprising a plurality of layers of facing sheets overlying both said front and back surfaces of said base sheet and secured thereto to thereby form pockets at both said front and back surface of said base sheet.

* * * * *